US011022920B2

(12) United States Patent
Kozuma et al.

(10) Patent No.: US 11,022,920 B2
(45) Date of Patent: Jun. 1, 2021

(54) IMAGE FORMING APPARATUS HAVING A RUBBING MEMBER THAT IS MOVEABLE TO ABUT A FIXING BELT

(71) Applicant: CANON KABUSHIKI KAISHA, Tokyo (JP)

(72) Inventors: Takeshi Kozuma, Tokyo (JP); Keisuke Yoshida, Tokyo (JP); Asuna Fukamachi, Kashiwa (JP); Shohei Tsuzaki, Nagareyama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/722,962

(22) Filed: Dec. 20, 2019

(65) Prior Publication Data

US 2020/0218179 A1 Jul. 9, 2020

(30) Foreign Application Priority Data

Jan. 8, 2019 (JP) ..... JP2019-000946

(51) Int. Cl.
*G03G 15/20* (2006.01)

(52) U.S. Cl.
CPC ..... *G03G 15/205* (2013.01); *G03G 15/2025* (2013.01); *G03G 15/2053* (2013.01); *G03G 2215/2016* (2013.01)

(58) Field of Classification Search
CPC .. G03G 15/205; G03G 15/2053; G03G 21/00; G03G 2215/2009; G03G 2215/2016; G03G 15/2025
USPC ..... 399/70, 329
See application file for complete search history.

(56) References Cited

U.S. PATENT DOCUMENTS 8,917,999 B2 * 12/2014 Takada ..... G03G 15/2025 399/320
8,918,043 B2 12/2014 Yoshida
9,098,027 B2 * 8/2015 Hasegawa ..... G03G 15/2042
9,261,825 B2 * 2/2016 Chiyoda ..... G03G 15/2025
(Continued)

FOREIGN PATENT DOCUMENTS

JP 2007-199596 A 8/2007
JP 2011175066 A * 9/2011
(Continued)

OTHER PUBLICATIONS

Co-pending U.S. Appl. No. 16/667,302, filed Oct. 29, 2019.

*Primary Examiner* — Robert B Beatty
(74) *Attorney, Agent, or Firm* — Venable LLP

(57) ABSTRACT

An image forming apparatus includes a control unit configured to perform a rubbing mode in which a rubbing rotatable member moves from a separation position to an abutment position in a state where a fixing belt is in a stop state. The control unit is configured to control a contact-and-separation mechanism in the rubbing mode such that if a predetermined temperature to which the fixing belt is heated is a first temperature, the rubbing rotatable member moves from the abutment position to the separation position at a timing when a first time has elapsed since the rubbing rotatable member abutted against the surface of the fixing belt, and if the predetermined temperature is a second temperature higher than the first temperature, the rubbing rotatable member moves from the abutment position to the separation position at a timing when a second time shorter than the first time has elapsed.

8 Claims, 7 Drawing Sheets

(56) References Cited

U.S. PATENT DOCUMENTS

| | | | | |
|---|---|---|---|---|
| 9,274,468 | B2 * | 3/2016 | Tadomi | G03G 15/2025 |
| 9,392,642 | B2 * | 7/2016 | Tanaka | H05B 1/0241 |
| 10,031,448 | B2 * | 7/2018 | Yoshimura | G03G 15/205 |
| 10,545,442 | B1 | 1/2020 | Hirano et al. | |
| 10,564,576 | B2 | 2/2020 | Tanaka et al. | |
| 2005/0185978 | A1 * | 8/2005 | Kemmochi | G03G 15/2039 399/69 |
| 2009/0297233 | A1 * | 12/2009 | Kameda | G03G 15/5029 399/322 |
| 2016/0216658 | A1 * | 7/2016 | Makino | G03G 15/2025 |
| 2020/0041940 | A1 | 2/2020 | Kawai et al. | |

FOREIGN PATENT DOCUMENTS

| | | | | |
|---|---|---|---|---|
| JP | 2015-72408 | A | 4/2015 | |
| JP | 2015-197594 | A | 11/2015 | |
| JP | 2016206299 | A * | 12/2016 | G03G 15/205 |
| JP | 2017-26804 | A | 2/2017 | |
| JP | 2017-161864 | A | 9/2017 | |

* cited by examiner

IMAGE FORMING APPARATUS HAVING A RUBBING MEMBER THAT IS MOVEABLE TO ABUT A FIXING BELT

BACKGROUND OF THE INVENTION

Field of the Invention

The present invention relates to image forming apparatuses, such as printers, copying machines, facsimiles, and multifunction printers, which use the electrophotography.

Description of the Related Art

Image forming apparatuses include a fixing device. The fixing device applies heat and pressure to a recording material on which a toner image is formed, for fixing the toner image to the recording material. For example, Japanese Patent Application Publication No. 2017-161864 proposes a freebelt fixing device that includes an endless fixing belt that rotates, a heater that abuts against the inner circumferential surface of the fixing belt and heats the fixing belt, and a roller (referred to as a pressure roller) that abuts against the outer circumferential surface of the fixing belt. In such a fixing device, the fixing belt is pressed by the pressure roller so that a fixing nip portion is formed between the fixing belt and the pressure roller. The recording material is conveyed through the fixing nip portion, while pressurized, heated, and held between the fixing belt and the pressure roller, so that a toner image is fixed to the recording material. Here, while rotated, the fixing belt may move in a width direction that is orthogonal to a rotational direction of the fixing belt. For this reason, at both end portions of the fixing belt in the width direction, regulation members are disposed. Thus, when the fixing belt moves in the width direction, each of the regulation members receives a corresponding one of the end portions of the fixing belt and regulates the movement of the fixing belt in the width direction.

The surface layer of the fixing belt is made of soft resin for preventing toner from adhering to the fixing belt from the recording material. The soft resin may be PFA or PTFE, and has good mold releasability. Thus, the surface of the fixing belt easily has a flaw in the rotational direction (circumferential direction) of the fixing belt, caused by a cut end (so-called paper edge) of an edge portion of the recording material. Here, the cut end is formed when the recording material is cut. The flaw on the surface of the fixing belt causes a linear image defect on the recording material, to which a toner image is fixed. Here, for a case where a fixing roller is used, Japanese Patent Application Publication No. 2007-199596 proposes a technique that equalizes the roughness of the surface of the fixing roller for reducing the flaw caused by the paper edge. Specifically, this technique causes a rubbing rotatable member to abut against the surface of the fixing roller for rubbing the surface. In the above-described Japanese Patent Application Publication No. 2007-199596, when the fixing operation is not performed, the rubbing rotatable member is moved from a separation position, at which the rubbing rotatable member does not abut against the surface of the fixing roller, to an abutment position at which the rubbing rotatable member abuts against the surface of the fixing roller that is rotating.

As in the case where the fixing roller is used, when a fixing belt is used in a fixing device, it is preferable that the surface of the fixing belt is rubbed by a rubbing rotatable member. In addition, for increasing the life of the fixing belt, it is preferable that the rubbing rotatable member abuts against the surface of the fixing belt when the fixing operation is not performed, and is separated from the surface of the fixing belt when the fixing operation is performed. However, if the rubbing rotatable member of the freebelt fixing device abuts against the fixing belt that is rotating, the fixing belt may be damaged, possibly torn. This is because when the rubbing rotatable member abuts against the rotating fixing belt, strong force will be instantaneously applied to a portion of the fixing belt, against which the rubbing rotatable member abuts, and the fixing belt will be twisted.

SUMMARY OF THE INVENTION

According to a one aspect of the present invention, an image forming apparatus includes an image forming unit configured to form a toner image on a recording material, a fixing device configured to fix the toner image to the recording material, the fixing device including an endless fixing belt, a heating member configured to heat the fixing belt to a predetermined temperature, a driving rotary member configured to abut against the fixing belt to form a fixing nip portion between the fixing belt and the driving rotary member and configured to drive and rotate the fixing belt, the fixing nip portion being formed to fix the toner image to the recording material, a plurality of regulation members configured to regulate movement of the fixing belt in a width direction perpendicular to a rotational axis of the driving rotary member, each regulating member is disposed outside of each end of the fixing belt in the width direction, a rubbing rotatable member configured to rub the fixing belt, and a contact-and-separation mechanism configured to move the rubbing rotatable member between an abutment position at which the rubbing rotatable member abuts against the fixing belt and a separation position at which the rubbing rotatable member is separated from the fixing belt, and a control unit configured to perform a rubbing mode in which after the rubbing rotatable member moves from the separation position to the abutment position in a state where the fixing belt is in a stop state, the driving rotary member rotates the fixing belt in a state where the rubbing rotatable member is located at the abutment position. The control unit is configured to control the contact-and-separation mechanism in the rubbing mode such that if the predetermined temperature is a first temperature, the rubbing rotatable member moves from the abutment position to the separation position at a timing when a first time has elapsed since the rubbing rotatable member abutted against the surface of the fixing belt, and if the predetermined temperature is a second temperature higher than the first temperature, the rubbing rotatable member moves from the abutment position to the separation position at a timing when a second time shorter than the first time has elapsed since the rubbing rotatable member abutted against the surface of the fixing belt.

Further features of the present invention will become apparent from the following description of exemplary embodiments with reference to the attached drawings.

DESCRIPTION OF THE EMBODIMENTS

First Embodiment

Image Forming Apparatus

Figure 1:
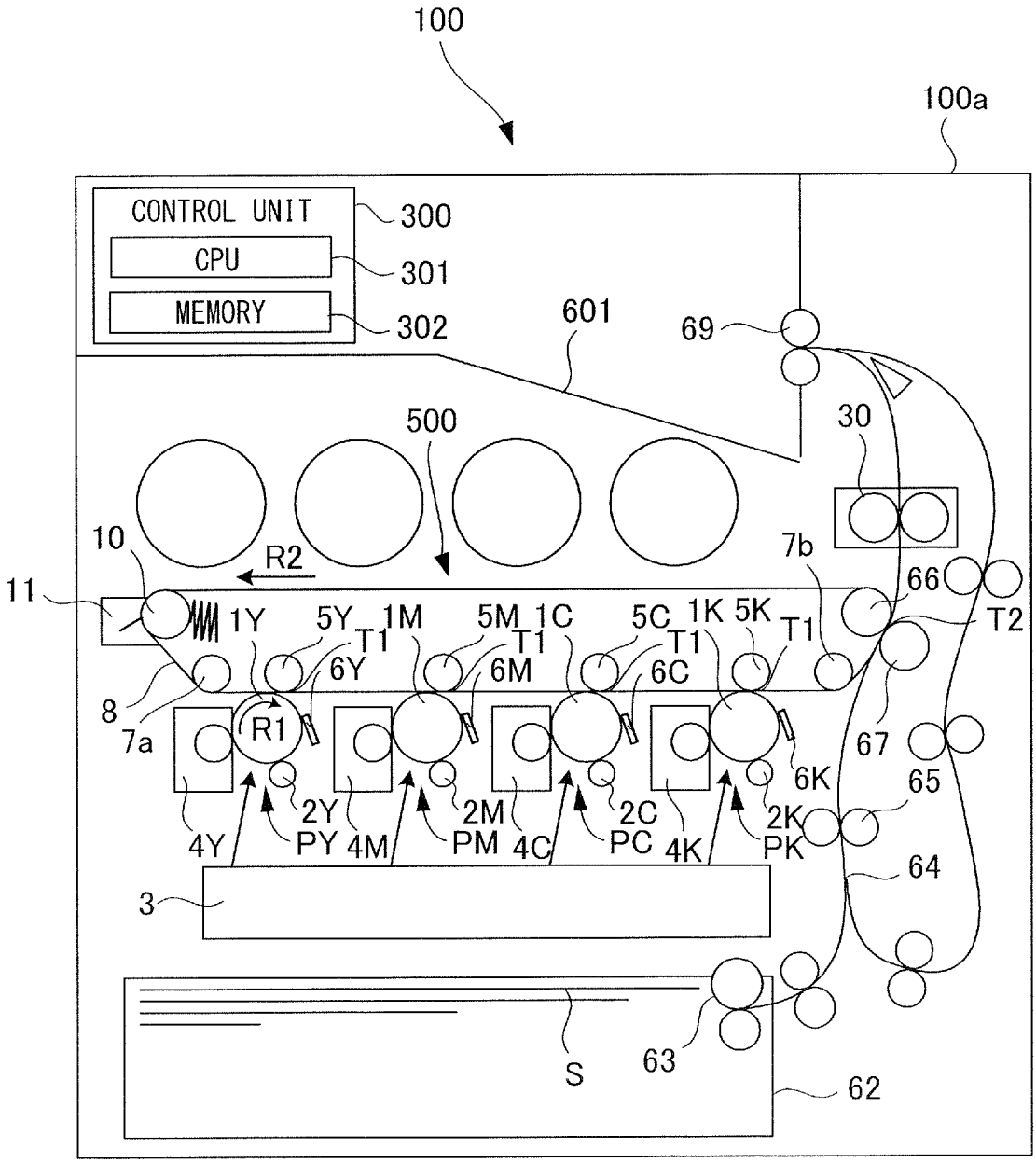
FIG. 1 is a diagram schematically illustrating a configuration of an image forming apparatus of a first embodiment.

A first embodiment will be described. First, an image forming apparatus of the present embodiment will be described with reference to FIG. 1. An image forming apparatus 100 of FIG. 1 is a color-image forming apparatus having a tandem intermediate-transfer system. Specifically, the image forming apparatus 100 includes an apparatus body 100*a* in which image forming portions PY, PM, PC, and PK for four colors (yellow, magenta, cyan, and black) are disposed facing an intermediate transfer belt 8. In the present embodiment, the Image forming portions PY to PK described later, primary transfer rollers 5Y to 5K, the intermediate transfer belt 8, a secondary transfer inner roller 66, and a secondary transfer outer roller 67 constitute an image forming unit 500, which forms a toner image on a recording material S. The recording material S may be a sheet material, such as a transfer sheet, an electrofax sheet, a dielectric-coated paper, an OHP sheet, a printing paper sheet, or a format paper sheet.

Next, a conveyance process of the image forming apparatus 100 for the recording material S will be described. The recording material S is stored in a cassette 62, and stacked on a stacking portion of the cassette 62. The recording material S is fed to a conveyance path 64, one by one, by a sheet feeding roller 63 at an image forming timing. Here, the recording material S may be stacked on a manual feed tray or a recording-material stacking apparatus (both not illustrated), and fed to the conveyance path 64 one by one. When the recording material S is conveyed to a registration roller 65 disposed on the conveyance path 64, the registration roller 65 performs skew correction and timing correction on the recording material S, and sends the recording material S to a secondary transfer portion T2. The secondary transfer portion T2 is a transfer nip portion formed between the secondary transfer inner roller 66 and the secondary transfer outer roller 67, which face each other. The recording material S is conveyed through the secondary transfer portion T2, while held between the secondary transfer inner roller 66 and the secondary transfer outer roller 67. In addition, when a secondary transfer voltage is applied to the secondary transfer outer roller 67, a toner image is secondary-transferred from the intermediate transfer belt 8 onto the recording material S.

In synchronization with the above-described conveyance process for the recording material S, which is performed between the cassette 62 and the secondary transfer portion T2, an image forming process is performed for sending an image to the secondary transfer portion T2. The image forming process will be described. First, the image forming portions PY to PK will be described. Here, the image forming portions PY to PK are substantially the same as each other in configuration, except that developing apparatuses 4Y, 4M, 4C, and 4K respectively use toner of yellow, magenta, cyan, and black. Thus, in the following description, the image forming portion PY for yellow will be described as an example, and the description for the other image forming portions PM, PC, and PK will be omitted.

Image Forming Portion

As illustrated in FIG. 1, the image forming portion PY includes a photosensitive drum 1Y, a charging apparatus 2Y, the developing apparatus 4Y, the primary transfer roller 5Y, and a drum cleaning apparatus 6Y The charging apparatus 2Y, the developing apparatus 4Y, the primary transfer roller 5Y, and the drum cleaning apparatus 6Y are disposed around the photosensitive drum 1Y The photosensitive drum 1Y serving as an image bearing member is a drum-like photoreceptor in electrophotography, and is rotatably supported by the apparatus body 100*a* and rotated by a motor (not illustrated) clockwise in FIG. 1 (in a direction indicated by an arrow R1 in FIG. 1). The surface of the rotary photosensitive drum 1Y is uniformly charged in advance by the charging apparatus 2Y, and then an electrostatic latent image is formed on the surface of the photosensitive drum 1Y by an exposure apparatus 3, which is driven in accordance with a corresponding image signal. The electrostatic latent image formed on the photosensitive drum 1Y is then developed into a toner image and visualized by the developing apparatus 4Y After that, a predetermined pressure and a primary transfer voltage are applied to the toner image formed on the photosensitive drum 1Y, and the toner image is primary-transferred onto the intermediate transfer belt 8. The primary transfer roller 5Y faces the photosensitive drum 1Y via the intermediate transfer belt 8, so that a primary transfer portion T1 for the toner image is formed between the photosensitive drum 1Y and the intermediate transfer belt 8. When the primary transfer voltage is applied to the primary transfer roller 5Y, the toner image is primary-transferred from the photosensitive drum 1Y onto the intermediate transfer belt 8 in the primary transfer portion T1. Remaining toner that is slightly left on the photosensitive drum 1Y after the primary transfer, is removed by the drum cleaning apparatus 6Y for the next image forming process.

As described above, each of the image forming portions PY to PK performs an image forming process for a corresponding color. In addition, the image forming process for each color is performed at a timing at which one toner image is transferred onto another toner image that was primary-transferred onto the intermediate transfer belt 8 at a position positioned upstream from the one toner image in the rotational direction of the intermediate transfer belt 8. As a result, a full-color toner image is formed on the intermediate transfer belt 8, and conveyed to the secondary transfer portion T2. Remaining toner on the intermediate transfer belt 8 left after the toner image has passed through the secondary transfer portion T2 is removed from the intermediate transfer belt 8 by a transfer cleaner 11.

Thus, the recording material S conveyed through the above-described conveyance process and the full-color toner image conveyed through the above-described image forming process are sent to the secondary transfer portion T2 at the same timing, and thereby the toner image is secondary-transferred from the intermediate transfer belt 8 onto the recording material S. After that, the recording material S on which the toner image has been formed by the image forming unit 500 is conveyed to the fixing device 30, and pressurized and heated by the fixing device 30 for fixing the toner image to the recording material S. The recording material S to which the toner image has been fixed by the fixing device 30 is discharged onto a sheet discharging tray 601 by a sheet discharging roller 69.

Fixing Device

Figure 2:
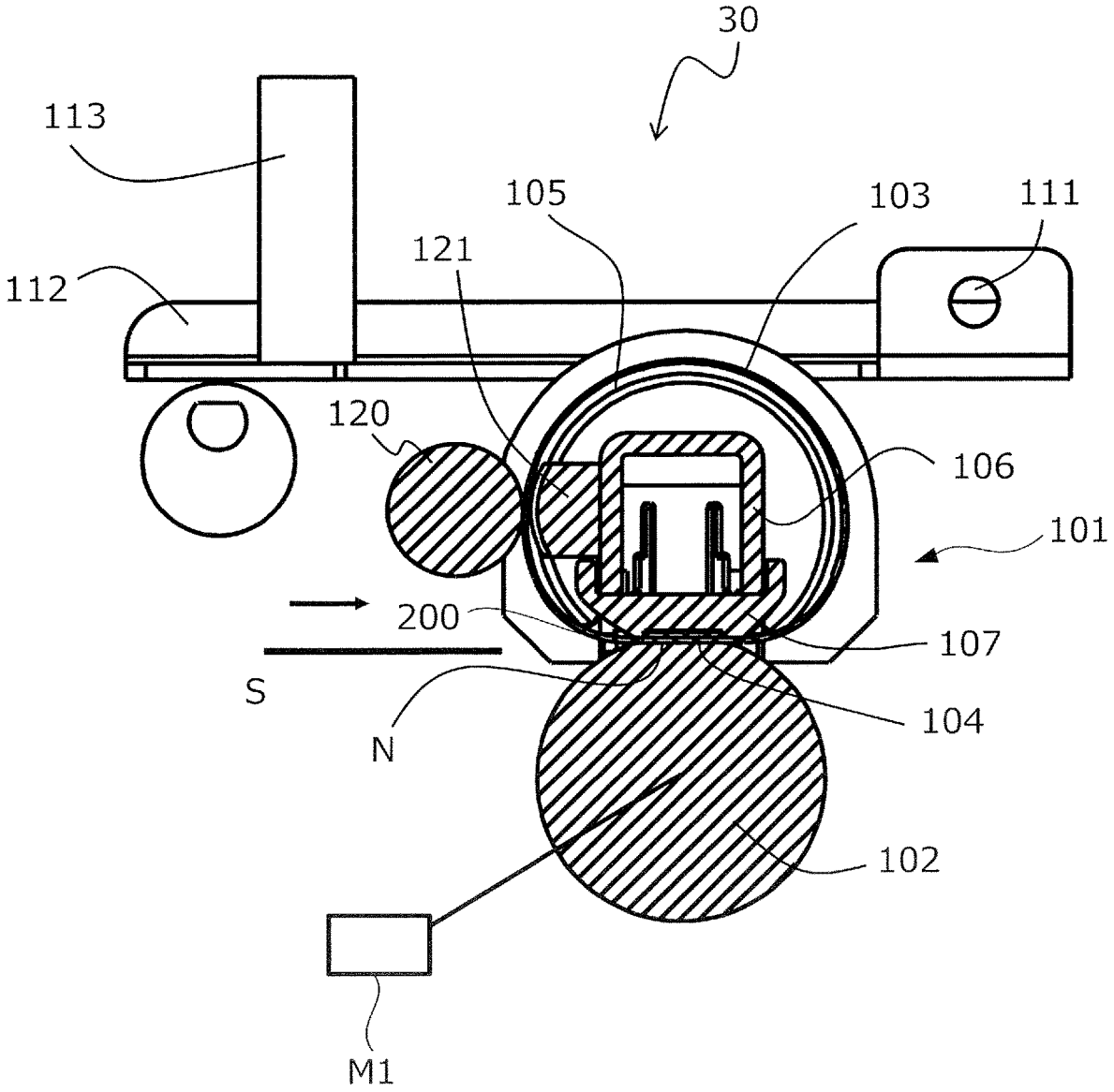
FIG. 2 is a cross-sectional view illustrating a fixing device of the first embodiment.

Next, the fixing device 30 of the present embodiment will be described with reference to FIG. 2. The fixing device 30 of the present embodiment is a so-called freebelt fixing device. As illustrated in FIG. 2, the fixing device 30 of the present embodiment includes a belt unit 101, a pressure roller 102, and a rubbing rotatable member 120. The pressure roller 102 is rotatably supported by the apparatus body. The pressure roller 102 is disposed in parallel with the belt unit 101. In addition, the pressure roller 102 is disposed so as to press a fixing belt 103 of the belt unit 101 when the pressure roller 102 abuts against the fixing belt 103. In the present embodiment, the belt unit 101 can move between a pressure position and a non-pressure position. The pressure position is a position at which the fixing belt 103 abuts against the pressure roller 102 and is pressed by the pressure roller 102, and the non-pressure position is a position at which the fixing belt 103 is separated from the pressure roller 102 and is not pressed by the pressure roller 102. Thus, the belt unit 101 is movably supported by a pressure lever 112 that is swung by a pressure motor (not illustrated).

The pressure lever 112 is disposed so as to be able to swing on a rotation center shaft 111 via a pressure spring 113. Thus, the belt unit 101 moves with respect to the pressure roller 102 in accordance with the swing of the pressure lever 112. When the belt unit 101 moves close to and abuts against the pressure roller 102, the fixing belt 103 is pressed by the pressure roller 102. Thus, the fixing belt 103 and the pressure roller 102 are pressed by each other, so that a fixing nip portion N is formed between the fixing belt 103 and the pressure roller 102. When the recording material S passes through the fixing nip portion N while pressed by the fixing belt 103 and the pressure roller 102, the toner image is fixed to the recording material S.

The pressure roller 102 may have an elastic layer formed on the outer circumferential surface of a metal rotation shaft (core metal) and made of silicone rubber, fluororubber, or fluororesin. In addition, the pressure roller 102 may further have a release layer formed on the outer circumferential surface of the elastic layer and made of fluororesin, such as PTFE, PFA, or FEP. In the present embodiment, the pressure roller 102 has a rotation shaft, an elastic layer, and a release layer. The diameter φ of the rotation shaft is 15 mm, the thickness of the elastic layer is 5 mm, and the thickness of the release layer is 50 μm. Thus, the outer diameter φ of the pressure roller 102 is about 25 mm. The elastic layer is made of silicone rubber having ASKER hardness of 64°, and the release layer is a PFA tube.

The pressure roller 102 can be rotated by a driving motor M1, which is a driving source. When the fixing nip portion N is formed between the fixing belt 103 and the pressure roller 102, the rotational force of the pressure roller 102 is transmitted to the fixing belt 103 by frictional force produced in the fixing nip portion N. In this manner, the fixing belt 103 is rotated by the pressure roller 102, which is a driving rotary member (this driving is so-called driving by pressure roller). The recording material S is conveyed through the fixing nip portion N by the rotating pressure roller 102 and the rotating fixing belt 103, while held between the pressure roller 102 and the fixing belt 103. Here, when the fixing belt 103 and the pressure roller 102 are not pressed by each other, the fixing nip portion N is not formed between the fixing belt 103 and the pressure roller 102, and the rotational force of the pressure roller 102 is not transmitted to the fixing belt 103.

Belt Unit

As illustrated in FIG. 2, the belt unit 101 includes the fixing belt 103 and flanges 105. The fixing belt 103 is endless, and has a cylindrical shape and flexibility. The flanges 105 is configured to abut against both ends, in the width direction orthogonal to the rotational direction of the fixing belt 103 (the width direction is equal to the rotation-axis direction of the pressure roller 102), of the fixing belt 103 and to regulate movement of the fixing belt 103 in the width direction. The fixing belt 103 is detachably attached to the belt unit 101. The fixing belt 103 may be a resin belt made of resin and having an elastic layer with high thermal conductivity and low thermal capacity. Alternatively, the fixing belt 103 may be a composite-layer belt having a structure in which a base layer, an elastic layer, and a release layer are formed. In this case, the base layer is a metal belt made of stainless steel (SUS) or the like, the elastic layer is formed on the outer circumferential surface of the base layer, and the release layer is formed on the outer circumferential surface of the elastic layer. In the present embodiment, the fixing belt 103 has a base layer made of SUS, an elastic layer made of silicone rubber with a thermal conductivity of about 1.0 W/m·K and having a thickness of about 250 μm, and a release layer that is a PFA tube having a thickness of 30 μm. The release layer is preferably a sheet or a coated layer having high mold releasability, and may be made of fluororesin, such as PFA or PTFE. In another case, the fixing belt 103 may have a base layer, a conductive layer, and a release layer. In this case, the base layer may be a sheet-like member having high thermal resistance and made of material such as polyester, polyethylene terephthalate, or polyamide-imide; the conductive layer may be formed on the base layer; and the release layer may be formed on the conductive layer, as a front surface. In addition, the fixing belt 103 disclosed herein may be a film-like belt.

The flanges 105 are externally fit in the belt unit 101, at both end portions of the fixing belt 103 in the width direction. When the fixing belt 103 moves in the width direction, each of the flanges 105, which serves as a regulation member, receives a corresponding one of the end portions of the fixing belt and regulates the movement of the fixing belt in the width direction. In other words, when the fixing belt 103 moves in the width direction while rotated by the pressure roller 102, one end portion of the fixing belt 103 in the width direction abuts against a corresponding one of the flanges 105, so that the fixing belt 103 is prevented from further moving in the width direction. Here, there is a case in which the pressure roller 102 and the fixing belt 103 are not perfectly parallel with each other because of an error caused when the pressure roller 102 and the fixing belt 103 are mounted. In this case, the rotating fixing belt 103 may be moved in the width direction by the rotating pressure roller 102. For this reason, the flanges 105 are externally fit in the belt unit 101 at both end portions of the fixing belt 103, for preventing the movement of the fixing belt 103 caused by the pressure roller 102 in the width direction.

The belt unit 101 also includes a stay 106, a pressing pad 107, and a backup member 121, which are disposed inside the fixing belt 103. The stay 106 may be a rigid metal member that extends in the width direction along the fixing belt 103, and supports the pressing pad 107 on a side opposite to the pressure roller 102 side. In the present embodiment, the pressing pad 107 supported by the stay 106 presses the inner circumferential surface of the fixing belt 103 against the pressure roller 102, and thereby more reliably forms the fixing nip portion N. The pressing pad 107 is made of a material having good insulation property and thermal resistance. Examples of the material include phenol resin, polyimide resin, polyamide resin, polyamide-imide resin, PEEK resin, PES resin, PPS resin, PFA resin, PTFE resin, and LCP resin.

The pressing pad 107 may be a molded product that extends in a longitudinal direction (i.e. width direction of the fixing belt 103), and is formed so as to be able to hold the heater 104, which is a heating member. That is, the pressing pad 107 has a fitting groove (not illustrated) in which the heater 104 is fit, and by which the heater 104 is held. The fitting groove is formed in a surface of the pressing pad 107 opposite to the stay 106, and extends along the longitudinal direction. The heater 104 held by the pressing pad 107 abuts against the inner circumferential surface of the fixing belt 103 and heats the fixing belt 103. The heater 104 may be a ceramic heater that includes a ceramic substrate formed like a thin plate and having a resistance layer. The resistance layer generates heat when current flows in the resistance layer, and thus the temperature of the heater 104 is adjustable. The inner circumferential surface of the fixing belt 103 is applied with lubricant for smoothly sliding the fixing belt 103 on the heater 104. Preferably, the lubricant is silicone oil.

In the present embodiment, temperature sensors 200 to detect the temperature of the heater 104 are disposed in the belt unit 101 for controlling the surface temperature of the fixing belt 103. In the present embodiment, the temperature sensors 200 may be contact-type sensors such as thermistors. In the present embodiment, the temperature sensors 200, which are detecting unit, are partly exposed from the pressing pad 107 toward the heater 104, and disposed at a plurality of positions along the longitudinal direction of the pressing pad 107 (i.e. rotation-axis direction of the pressure roller 102). Thus, in the present embodiment, the surface temperature of the fixing belt 103 can be detected by the temperature sensors 200. Preferably, the temperature sensors 200 are disposed at at least a center portion and end portions of the fixing belt 103 in the width direction.

The backup member 121 is a sliding member. When the later-described rubbing rotatable member 120 is positioned at the abutment position, the fixing belt 103 slides on the backup member 121; when the rubbing rotatable member 120 is positioned at the separation position, the fixing belt 103 does not slide on the backup member 121. That is, the backup member 121 is firmly positioned inside the fixing belt 103 such that when the rubbing rotatable member 120, which is moved by a later-described contact-and-separation mechanism 400 (see FIG. 3), is positioned at the abutment position at which the rubbing rotatable member 120 abuts against the fixing belt 103, the fixing belt 103 is held between the rubbing rotatable member 120 and the backup member 121. When the rubbing rotatable member 120 abuts against the fixing belt 103, the fixing belt 103 is pressed toward the backup member 121, and the backup member 121 abuts against the inner circumferential surface of the fixing belt 103. With this operation, the rubbing operation for the surface of the fixing belt 103 can be properly performed by the rubbing rotatable member 120. In addition, the backup member 121 is disposed such that a clearance is formed between the backup member 121 and the inner circumferential surface of the fixing belt 103 when the rubbing rotatable member 120 is located at the separation position, at which the rubbing rotatable member 120 is separated from the fixing belt 103. When the rubbing rotatable member 120 is separated from the fixing belt 103, the fixing belt 103 having been pressed by the rubbing rotatable member 120 expands toward the rubbing rotatable member 120, and the inner circumferential surface of the fixing belt 103 is separated from the backup member 121. With this operation, when the rubbing rotatable member 120 is separated from the fixing belt 103, the backup member 121 does not scrape off the lubricant applied to the inner circumferential surface of the fixing belt 103. The backup member 121 may be made of heat-resistant resin such as liquid crystal polymer, or made of soft rubber material such as sponge or silicone rubber.

The rubbing rotatable member 120 is disposed to abut against the surface of the fixing belt 103 and rub the surface for equalizing the roughness of the surface of the fixing belt 103 and reducing flaw caused by the paper edge. The rubbing rotatable member 120 is a roller having a core metal, an adhesive layer, and a rubbing layer. The core metal has an outer diameter of 12 mm for example, and is made of SUS. The adhesive layer is formed on the core metal; and the rubbing layer is formed on the adhesive layer, as a surface layer. The rubbing layer is formed by causing densely-distributed abrasive grains, which serve as a rubbing material, to adhere to the adhesive layer. Thus, the rubbing layer is formed unevenly. In the present embodiment, the rubbing material is white alundum (WA) having an average particle diameter of about 12 μm. The average particle diameter of the rubbing material may be equal to or larger than 5 μm and equal to or smaller than 20 μm. Examples of the material of the abrasive grains include aluminum oxide, aluminum hydroxide oxide, silicon oxide, cerium oxide, titanium oxide, zirconia, lithium silicate, silicon nitride, silicon carbide, iron oxide, chromium oxide, antimony oxide, diamond, and a mixture thereof. Here, the particle diameter of the abrasive grains can be obtained by randomly picking up 100 or more abrasive grains by using a scanning electron microscope, S-4500 made by Hitachi, Ltd., and by calculating a number average particle diameter by using an image processing and analysis apparatus, Luzex3 made by NIRECO CORPORATION.

Contact-and-Separation Mechanism

The rubbing rotatable member 120 is disposed so as to be able to move between the abutment position at which the rubbing rotatable member 120 abuts against the surface of the fixing belt 103 and the separation position at which the rubbing rotatable member 120 is separated from the surface of the fixing belt 103. When the rubbing rotatable member 120 is located at the abutment position, the rubbing rotatable member 120 slides on the fixing belt 103 and rubs the surface of the fixing belt 103. For moving the rubbing rotatable member 120 between the abutment position and the separation position, the fixing device 30 of the present embodiment includes a contact-and-separation mechanism 400. The contact-and-separation mechanism 400 will be described with reference to FIGS. 3 to 5B.

Figure 3:
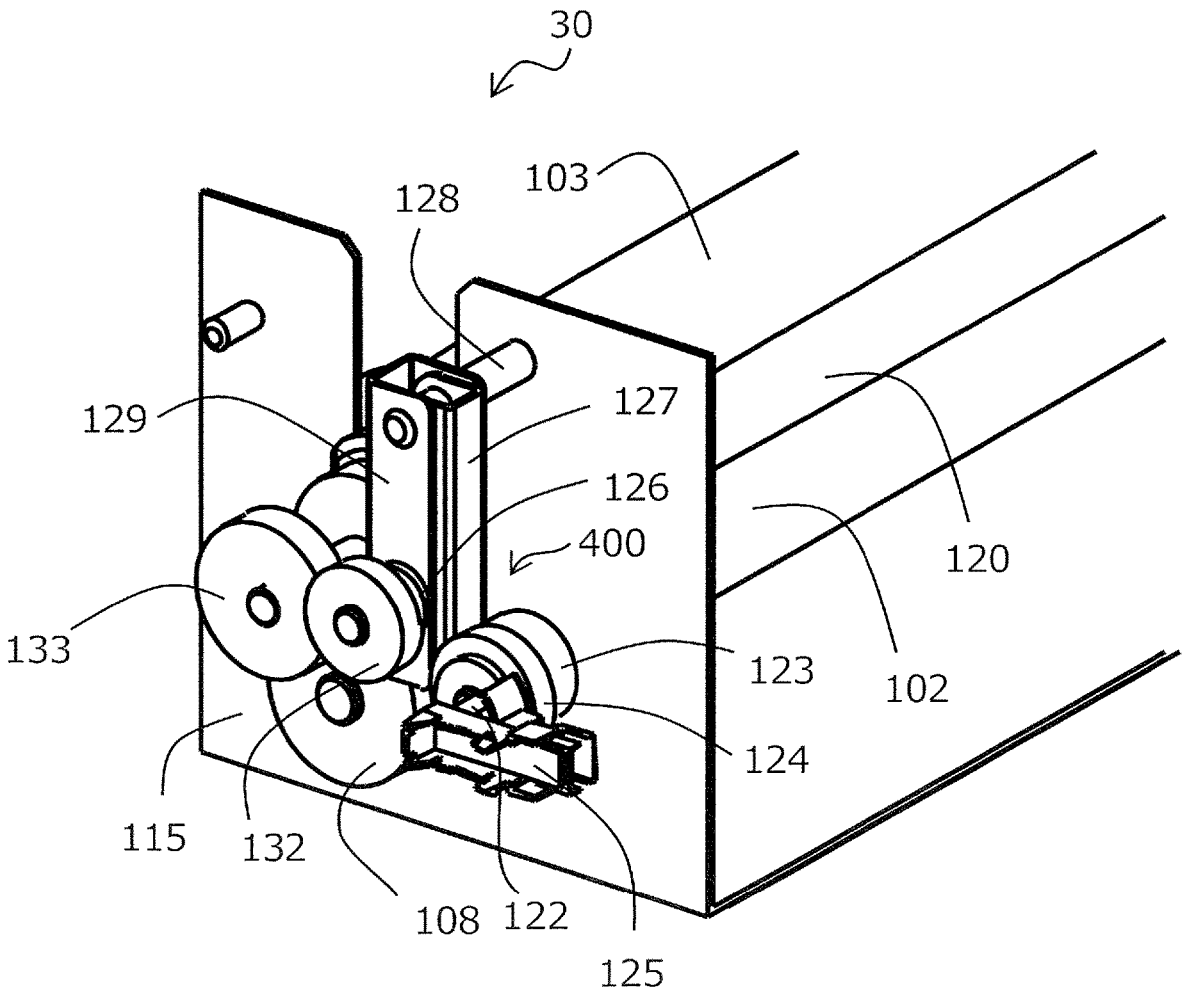
FIG. 3 is a perspective view illustrating a contact-and-separation mechanism and a rotation mechanism for a rubbing rotatable member.
Figure 4:
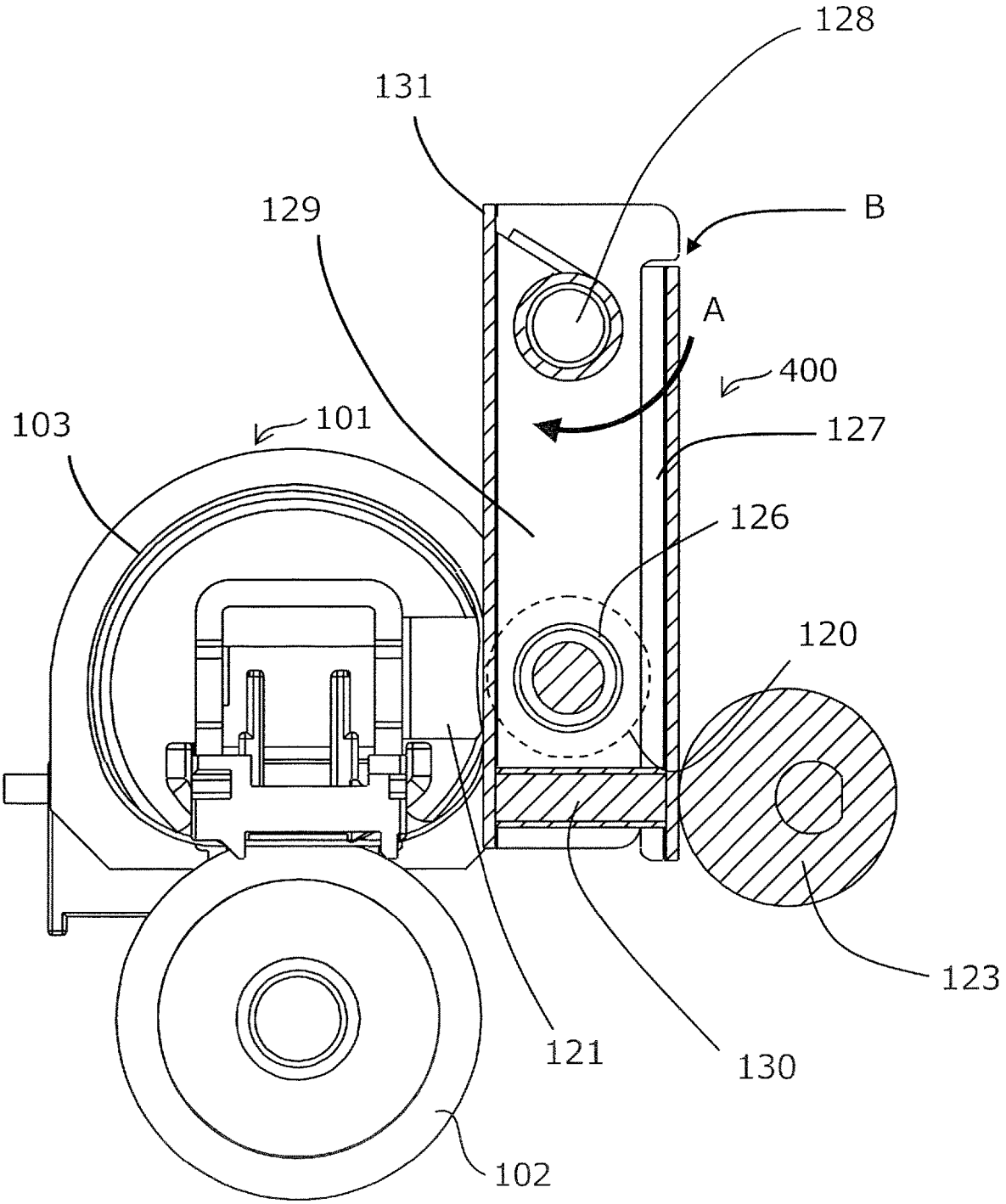
FIG. 4 is a cross-sectional view illustrating the contact-and-separation mechanism.

As illustrated in FIG. 3, the contact-and-separation mechanism 400 includes a rubbing rotatable member bearing 126, a supporting arm 129, and a pressure arm 127. The supporting arm 129 is rotatably supported by a fixed shaft 128, which is disposed on the frame 115. Similarly, the pressure arm 127 is rotatably supported by the fixed shaft 128. The rubbing rotatable member 120 is rotatably supported by the supporting arm 129 via the rubbing rotatable member bearing 126 so as to be able to rotate with respect to the supporting arm 129. In addition, as illustrated in FIG. 4, a pressure spring 130 is disposed between the supporting arm 129 and the pressure arm 127. In addition, a separation spring 131 is disposed such that one end of the separation spring 131 is supported by the frame 115 (see FIG. 3) and the other end is joined with the pressure arm 127. The separation spring 131 may be a torsion coil spring that urges the pressure arm 127 toward a rubbing rotatable member cam 123.

As illustrated in FIG. 3, a rubbing rotatable member cam shaft 122 is supported by the frame 115, and the rubbing rotatable member cam 123 and a rubbing rotatable member cam gear 124 are fixed to the rubbing rotatable member cam shaft 122. When a cam driving motor (not illustrated) is driven, the rubbing rotatable member cam shaft 122 is rotated, via the rubbing rotatable member cam gear 124, by a driving-gear train coupled with the cam driving motor. As a result, the rubbing rotatable member cam 123 is rotated. The rubbing rotatable member cam 123 is stopped at a desired rotation angle by using a sensor 125, and thus the rubbing rotatable member 120 is positioned at the abutment position or the separation position.

Figure 5A:
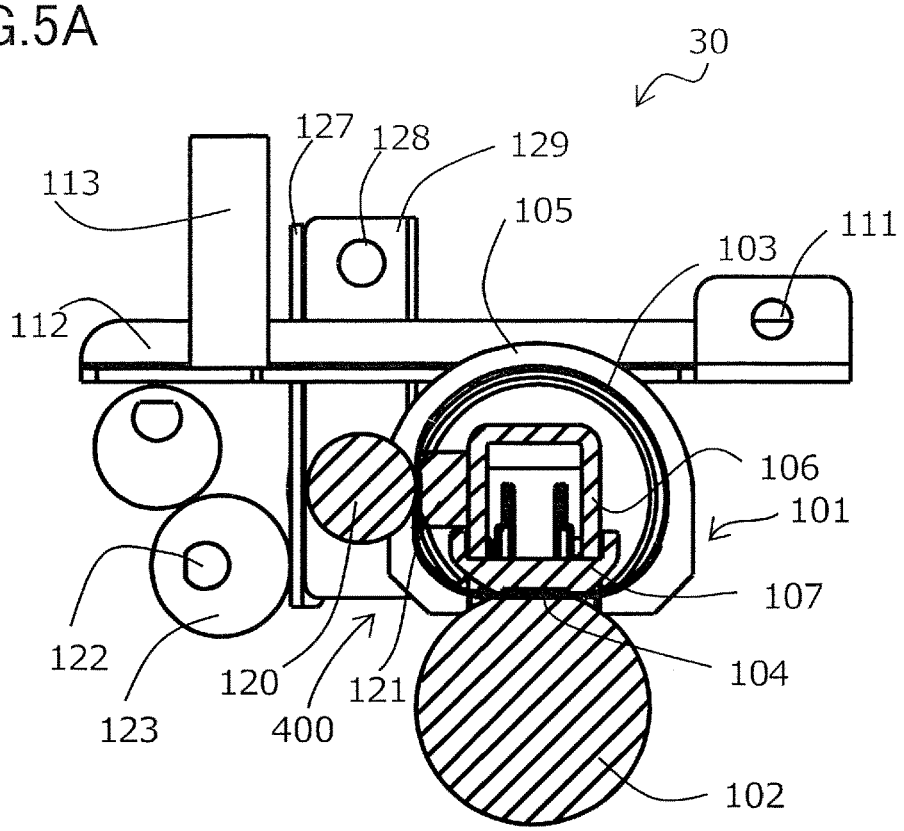
FIG. 5A is a diagram illustrating the contact-and-separation mechanism in a state where the rubbing rotatable member is located at an abutment position.
Figure 5B:
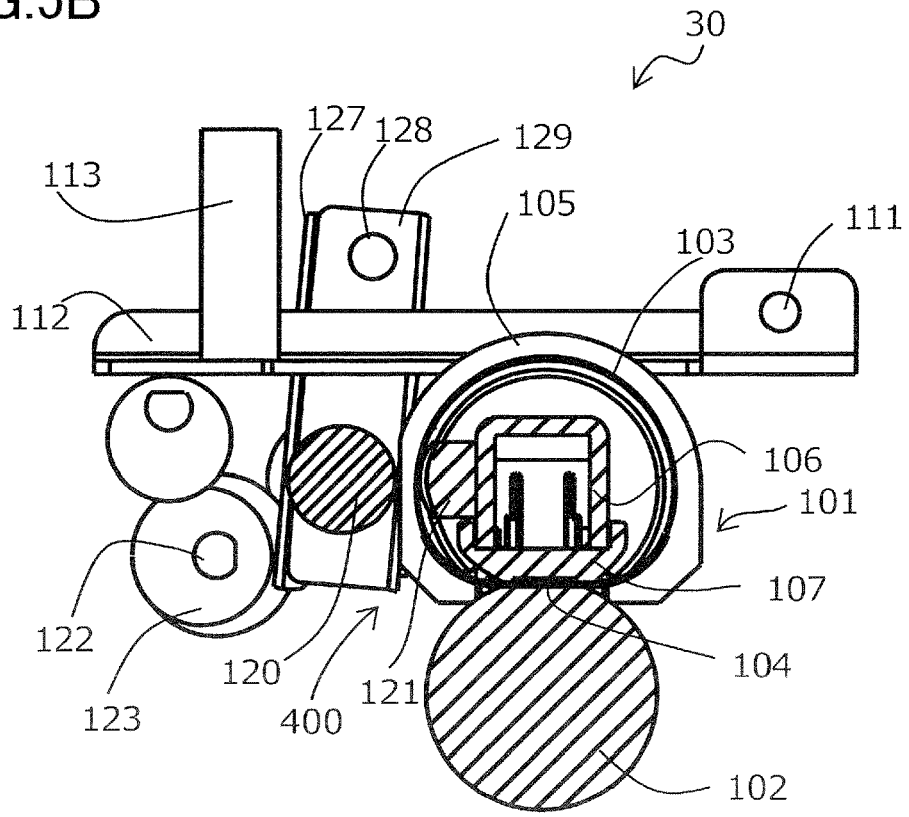
FIG. 5B is a diagram illustrating the contact-and-separation mechanism in a state where the rubbing rotatable member is located at a separation position.

Hereinafter, an abutment operation to move the rubbing rotatable member 120 to the abutment position and a separation operation to move the rubbing rotatable member 120 to the separation position will be described with reference to FIGS. 4 to 5B. First, the abutment operation to move the rubbing rotatable member 120 to the abutment position will be described. When the rubbing rotatable member cam 123 rotates counterclockwise, the pressure arm 127 is pushed by the rubbing rotatable member cam 123 and rotated toward a direction indicated by an arrow A in FIG. 4. When the pressure arm 127 is pushed, the supporting arm 129 is pushed by the pressure spring 130 and also rotated toward the direction indicated by the arrow A in FIG. 4. Then, the rubbing rotatable member 120 supported by the supporting arm 129 abuts against the backup member 121, and stops while pressed by a predetermined amount of abutment force. Thus, as illustrated in FIG. 5A, the rubbing rotatable member 120 moves to the abutment position, and is pressed against the fixing belt 103.

Next, the separation operation to move the rubbing rotatable member 120 to the separation position will be described. When the rubbing rotatable member cam 123 rotates clockwise, the pressure arm 127 is rotated by the urging force of the separation spring 131, toward a direction opposite to the direction indicated by the arrow A of FIG. 4. In this time, since the pressure arm 127 pushes the supporting arm 129 at a portion indicated by an arrow B of FIG. 4, the supporting arm 129 also rotates toward the same direction, together with the pressure arm 127. With this operation, the rubbing rotatable member 120 moves to the separation position, as illustrated in FIG. 5B, so as to retract from the fixing belt 103. In this manner, the rubbing rotatable member 120 moves between the abutment position illustrated in FIG. 5A and the separation position illustrated in FIG. 5B by moving up and down, in accordance with the rotation of the rubbing rotatable member cam 123.

In the present embodiment, when the rubbing rotatable member 120 is located at the abutment position, the rubbing rotatable member 120 rotates in the same rotational direction as that of the fixing belt 103. Specifically, as illustrated in FIG. 3, the rubbing rotatable member gear 132 is coupled with the rubbing rotatable member 120 on the axis of the rubbing rotatable member 120, and a pressure roller gear 108 is coupled with the pressure roller 102. When the rubbing rotatable member 120 is moved from the separation position to the abutment position by the contact-and-separation mechanism 400, the rubbing rotatable member gear 132 is moved together with the rubbing rotatable member 120, and coupled with a gear 133 that is coupled with the pressure roller gear 108. With this operation, the driving force of the driving motor M1 (see FIG. 2), which drives the pressure roller 102, is transmitted to the rubbing rotatable member gear 132 via the pressure roller gear 108 and the gear 133, so that the rubbing rotatable member 120 is rotated. In the present embodiment, the rubbing rotatable member 120 rotates at a rotational speed higher than that of the fixing belt 103, which is rotated by the rotation of the pressure roller 102 (for example, the speed ratio is in a range from 105 to 115%). Thus, the gear ratio between the rubbing rotatable member gear 132, the pressure roller gear 108, and the gear 133 is set to achieve the speed ratio. The rubbing rotatable member gear 132 is a driving-force transmission portion (a driving-force transmission member), which can be linked with the driving motor M1 and can rotate the rubbing rotatable member 120 when linked with the driving motor M1. On the other hand, when the rubbing rotatable member 120 is moved from the abutment position to the separation position by the contact-and-separation mechanism 400, the rubbing rotatable member gear 132 and the pressure roller gear 108 are separated from each other. Thus, since the rubbing rotatable member gear 132 is separated from the driving motor M1, the driving force of the driving motor M1 is not transmitted to the rubbing rotatable member gear 132 and the rubbing rotatable member 120 stops.

Control Unit

As illustrated in FIG. 1, the image forming apparatus 100 includes a control unit 300. The control unit 300, which is a control means, includes a central processing unit (CPU) 301 and a memory 302. The CPU 301 performs various types of control, such as an image forming operation, on the image forming apparatus 100. The memory 302 includes a read only memory (ROM) and a random access memory (RAM); and stores various types of programs and various types of data, such as table data, for controlling the image forming apparatus 100. The CPU 301 can perform an image forming job (program) stored in the memory 302, and operates the image forming apparatus 100 for forming images. In the present embodiment, the CPU 301 can perform a belt-surface rubbing process (program) (see FIGS. 6 and 7 described later) stored in the memory 302, and operate the image forming apparatus 100 for rubbing the surface of the fixing belt 103. When the CPU 301 performs the belt-surface rubbing process, the control unit 300 can control the heater 104 illustrated in FIG. 2, the driving motor M1, the contact-and-separation mechanism 400 illustrated in FIG. 3, and the like. In addition, the CPU 301 has a counter function to count the cumulative number of recording materials S on which images have been formed, and a timer function to measure an elapsed time. The CPU 301 causes the memory 302 to store data on the cumulative number of recording materials S and data on the elapsed time. The memory 302 can temporarily store results of computation performed in each program.

As described above, the surface layer of the fixing belt 103 is made of soft resin, such as PFA or PTFE, having good mold releasability so that the melted toner, melted by heat when a toner image is fixed, does not adhere to the surface layer of the fixing belt 103. Thus, as the cumulative number of image-formed recording materials S increases, the fixing belt 103 easily has a flaw on its surface due to the paper edge of the recording material S. The flaw on the surface of the fixing belt 103 causes a linear image defect. For this reason, the rubbing rotatable member 120 is disposed to abut against the surface of the fixing belt 103 and rubs the surface for equalizing the roughness of the surface of the fixing belt 103 and reducing the flaw caused by the paper edge.

However, as described above, if the rubbing rotatable member 120 of the freebelt fixing device 30 abuts against the rotating fixing belt 103, the stress applied to an end portion of the fixing belt 103 will increase rapidly, possibly damaging the end portion of the fixing belt 103. For this reason, in the present embodiment, the rubbing rotatable member 120 abuts against the fixing belt 103 that is not rotating. Hereinafter, specific descriptions will be made.

Belt-Surface Rubbing Process

A belt-surface rubbing process of the first embodiment will be described with reference to FIGS. 1 to 3 and FIG. 6. The belt-surface rubbing process (rubbing mode) of the present embodiment is performed by the control unit 300 (specifically by the CPU 301) when the power for the apparatus body is turned on, or every time the cumulative number of image-formed recording materials S reaches a predetermined value (e.g. 1,000).

Figure 6:
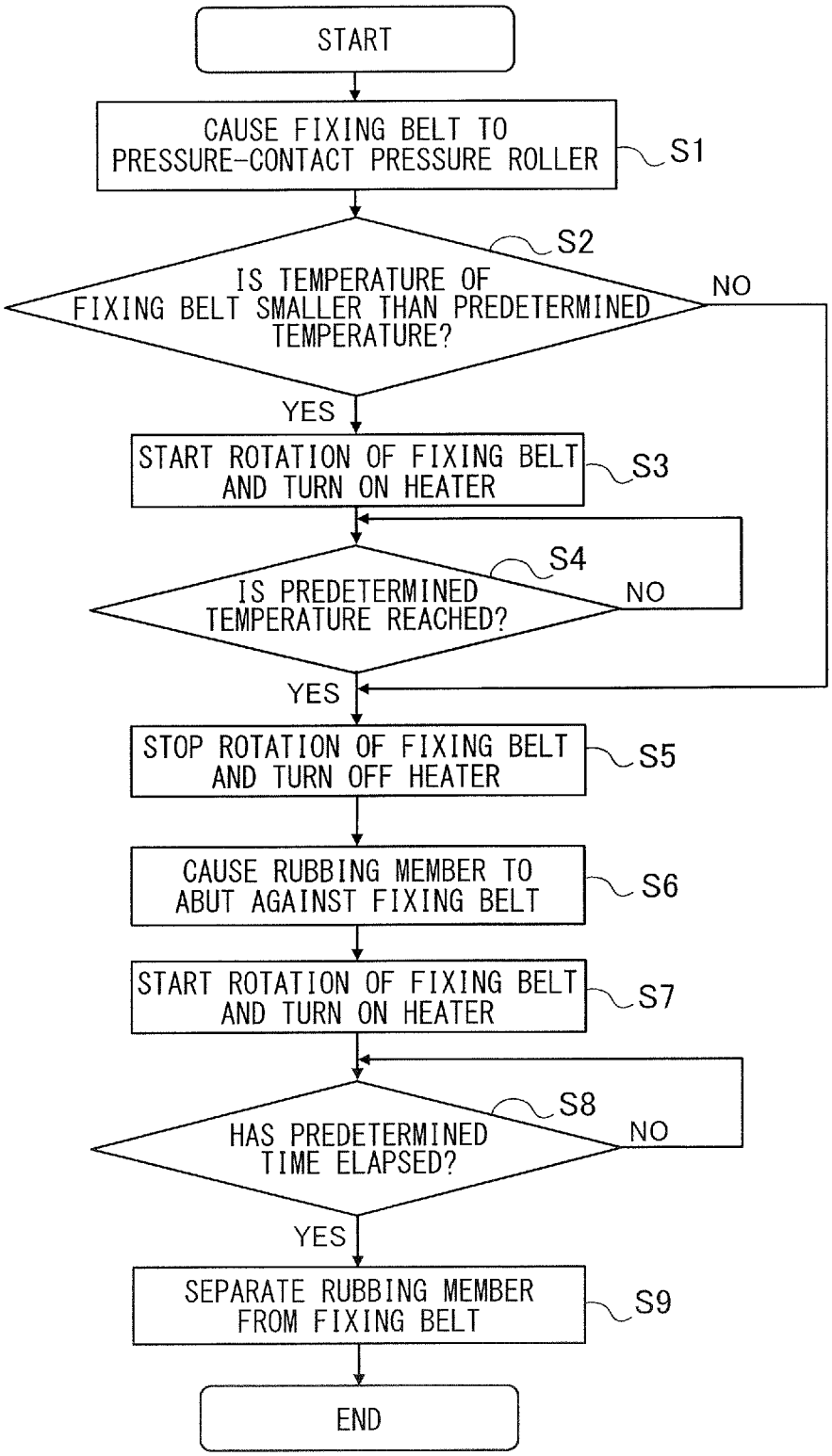
FIG. 6 is a flowchart illustrating a belt-surface rubbing process of the first embodiment.

As illustrated in FIG. 6, when the fixing belt 103 is located at the non-pressure position at which the fixing belt is separated from the pressure roller 102 and is not pressed by the pressure roller 102, the control unit 300 drives the pressure lever 112 by driving the pressure motor (not illustrated) and moves the fixing belt 103 from the non-pressure position to the pressure position (S1). For example, when the power for the apparatus body is turned on, the fixing belt 103 is located at the non-pressure position and is in a stop state. Here, when the fixing belt 103 is already located at the pressure position, the control unit 300 keeps the position of the fixing belt 103. The control unit 300 then obtains detection results from the temperature sensors 200, and determines depending on the detection results whether the surface temperature of the fixing belt 103 is smaller than a predetermined temperature (e.g. target temperature in a range from 100 to 150° C.) (S2). If the surface temperature of the fixing belt 103 is equal to or larger than the predetermined temperature (S2: NO), then the control unit 300 proceeds to Step S5.

If the surface temperature of the fixing belt 103 is smaller than the predetermined temperature (S2: YES), then the control unit 300 rotates the fixing belt 103 by driving the pressure roller 102 by driving the driving motor M1, and causes the heater 104 to heat the fixing belt 103 (S3). The control unit 300 causes the heater 104 to keep heating the fixing belt 103 until the surface temperature of the fixing belt 103 reaches the predetermined temperature (e.g. temperature in a range from 100 to 150° C.) (S4: NO). If the surface temperature of the fixing belt 103 is equal to or larger than the predetermined temperature (S4: YES), the control unit 300 causes the heater 104 to stop heating the fixing belt 103, and stops the rotation of the fixing belt 103 by stopping the pressure roller 102 by stopping the driving motor M1 (S5).

Then, the control unit 300 operates the contact-and-separation mechanism 400 to move the rubbing rotatable member 120 from the separation position to the abutment position for the fixing belt 103 whose surface temperature is equal to or larger than the predetermined temperature and which is in a stop state (S6). After moving the rubbing rotatable member 120 to the abutment position, the control unit 300 rotates the fixing belt 103 by driving the pressure roller 102 by driving the driving motor M1, and causes the heater 104 to heat the fixing belt 103 (S7). In this operation, since the driving force of the driving motor M1 is transmitted to the rubbing rotatable member gear 132 via the pressure roller gear 108 and the gear 133 as described above, the rubbing rotatable member 120 located at the abutment position is rotated. The fixing belt 103 is heated by the heater 104 again to prevent the temperature fall of the fixing belt 103 caused by the rubbing rotatable member 120 and keep the surface temperature of the fixing belt 103 at the predetermined temperature. With this operation, the surface of the fixing belt 103 can be efficiently rubbed by the rubbing rotatable member 120.

The control unit 300 then determines whether a predetermined time has elapsed since the rubbing rotatable member 120 moved to the abutment position (S8). If the predetermined time has elapsed (S8: YES), then the control unit 300 operates the contact-and-separation mechanism 400 to move the rubbing rotatable member 120 from the abutment position to the separation position (S9), and completes the belt-surface rubbing process.

As described above, in the present embodiment, when the fixing belt 103 is in a stop state, the control unit 300 moves the rubbing rotatable member 120, which rubs the surface of the fixing belt 103, from the separation position to the abutment position, and then rotates the fixing belt 103. Thus, when the rubbing rotatable member 120 abuts against the fixing belt 103 that is in a stop state, the large amount of force is not applied to an end portion of the fixing belt 103, unlike the case where the rubbing rotatable member 120 abuts against the fixing belt 103 that is rotating. Thus, the end portion of the fixing belt 103 cannot be damaged. That is, when the fixing belt 103 is rotated after the rubbing rotatable member 120 is moved to the abutment position, the abutment force of the rubbing rotatable member 120 is stably applied to the fixing belt 103 and the stress applied to an end portion of the fixing belt 103 does not rapidly increase. Therefore, in the present embodiment, the end portion of the fixing belt 103 can be prevented from being damaged.

In addition, in the present embodiment, the contact time (i.e. predetermined time in S8) taken from the abutment of the rubbing rotatable member 120 against the fixing belt 103 to the separation of the rubbing rotatable member 120 from the fixing belt 103 differs depending on the target temperature (i.e. predetermined temperature in S4) of the fixing belt 103. Here, the higher the target temperature of the fixing belt 103, the more easily the rubbing rotatable member 120 rubs the surface of the fixing belt 103. Thus, when the target temperature of the fixing belt 103 is a first temperature, the rubbing rotatable member 120 is moved from the abutment position to the separation position at a timing when a first time has elapsed since the rubbing rotatable member 120 abutted against the fixing belt 103. When the target temperature of the fixing belt 103 is a second temperature higher than the first temperature, the rubbing rotatable member 120 is preferably moved from the abutment position to the separation position at a timing when a second time shorter than the first time has elapsed since the rubbing rotatable member 120 abutted against the fixing belt 103. In this manner, since the time of the rubbing mode is shortened, the downtime of the image forming apparatus can be reduced, and thus the image forming apparatus can be efficiently operated.

Second Embodiment

In the above-described belt-surface rubbing process of the first embodiment, the rubbing rotatable member 120 is moved from the separation position to the abutment position after the fixing belt 103 is heated to the target temperature. The present disclosure, however, is not limited to this. For example, the rubbing rotatable member 120 may be moved from the separation position to the abutment position before the fixing belt 103 is heated to the target temperature. Hereinafter, a belt-surface rubbing process of a second embodiment will be described with reference to FIGS. 1 to 3 and FIG. 7. Here, in the second embodiment illustrated in FIG. 7, a process identical to a process of the belt-surface rubbing process of the first embodiment illustrated in FIG. 6 is given an identical symbol, and the description thereof will be simplified.

Figure 7:
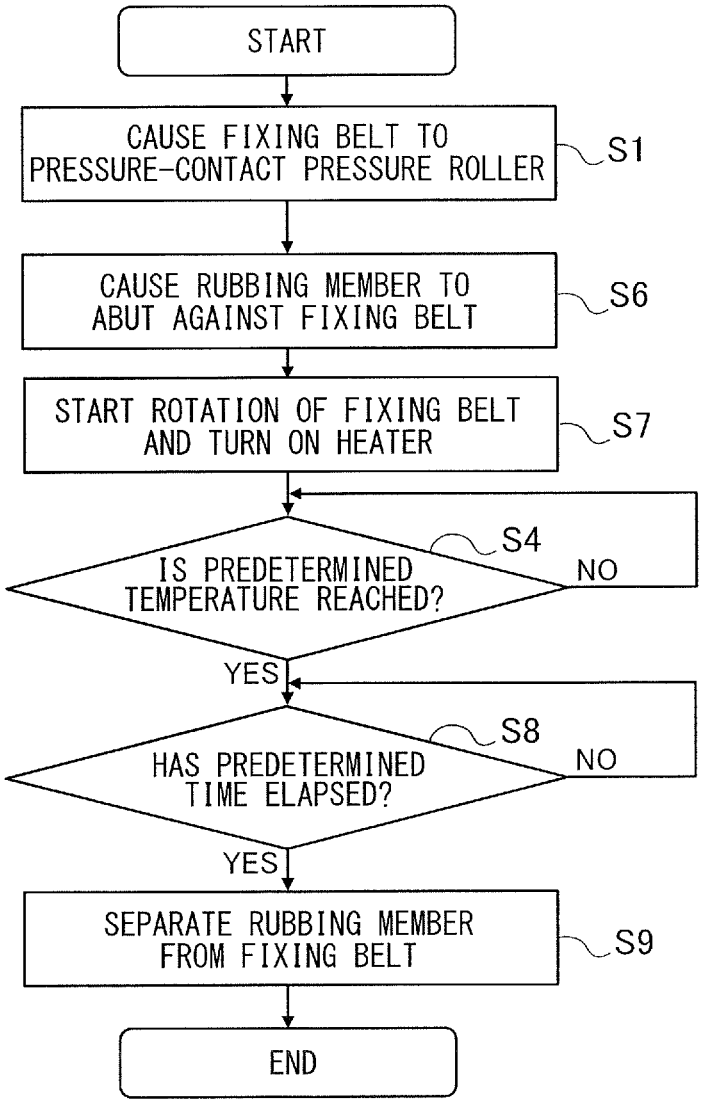
FIG. 7 is a flowchart illustrating a belt-surface rubbing process of a second embodiment.

As illustrated in FIG. 7, when the fixing belt 103 is located at the non-pressure position at which the fixing belt is separated from the pressure roller 102 and is not pressed by the pressure roller 102, the control unit 300 moves the fixing belt 103 from the non-pressure position to the pressure position (S1). In this time, if the pressure roller 102 is rotating, the control unit 300 stops the rotation of the pressure roller 102 by stopping the driving motor M1. That is, the control unit 300 causes the fixing belt 103 to be in a stop state. Then, the control unit 300 operates the contact-and-separation mechanism 400 to move the rubbing rotatable member 120 from the separation position to the abutment position for the fixing belt 103 that is in a stop state (S6).

After moving the rubbing rotatable member 120 to the abutment position, the control unit 300 rotates the fixing belt 103 by driving the pressure roller 102 by driving the driving motor M1, and causes the heater 104 to heat the fixing belt 103 (S7). In this operation, the rubbing rotatable member 120 located at the abutment position is rotated, as described above. In addition, the control unit 300 causes the heater 104 to keep heating the fixing belt 103 until the surface temperature of the fixing belt 103 reaches a predetermined temperature (e.g. temperature in a range from 100 to 150° C.) (S4: NO). On the other hand, if the surface temperature of the fixing belt 103 reaches the predetermined temperature (S4: YES), the control unit 300 determines whether a predetermined time has elapsed since the rubbing rotatable member 120 moved to the abutment position (S8). If the predetermined time has elapsed (S8: YES), the control unit 300 operates the contact-and-separation mechanism 400 to move the rubbing rotatable member 120 from the abutment position to the separation position (S9), and completes the belt-surface rubbing process.

As described above, also in the present embodiment, when the fixing belt 103 is in a stop state, the control unit 300 operates the contact-and-separation mechanism 400 to move the rubbing rotatable member 120, which rubs the surface of the fixing belt 103, from the separation position to the abutment position, and then rotates the fixing belt 103. Therefore, also in the present embodiment, an end portion of the fixing belt 103 can be prevented from being damaged, as in the above-described first embodiment.

In addition, in the present embodiment, the contact time (i.e. predetermined time in S8) taken from the abutment of the rubbing rotatable member 120 against the fixing belt 103 to the separation of the rubbing rotatable member 120 from the fixing belt 103 differs depending on the time that the surface temperature of the fixing belt 103 takes to reach the target temperature (i.e. predetermined temperature in S4) of the fixing belt 103. For example, when the predetermined temperature of the fixing belt 103 is a first temperature, the rubbing rotatable member 120 is moved from the abutment position to the separation position at a timing when a first time has elapsed since the surface temperature of the fixing belt 103 reached the first temperature. When the predetermined temperature of the fixing belt 103 is a second temperature higher than the first temperature, the rubbing rotatable member 120 is moved from the abutment position to the separation position at a timing when a second time shorter than the first time has elapsed since the surface temperature of the fixing belt 103 reached the second temperature. With this operation, the surface of the fixing belt 103 can be sufficiently rubbed by the rubbing rotatable member 120.

Modifications

In the above-described embodiments, the predetermined temperature for the fixing belt 103 is reached. However, the present disclosure is not limited to this. For example, the rubbing rotatable member 120 may be in contact with the fixing belt 103 for a predetermined time, without the surface temperature of the fixing belt 103 reaching the predetermined temperature (that is, without controlling the surface temperature of the fixing belt 103). However, it is preferable that the rubbing rotatable member 120 rubs the surface of the fixing belt 103 whose surface temperature has reached the predetermined temperature, as described above. This is because the surface of the fixing belt 103 can be sufficiently rubbed. Here, whether the surface temperature of the fixing belt 103 is controlled may be selected by a user.

In addition, in the image forming apparatus of the above-described embodiments, toner images having different colors are primary-transferred from the photosensitive drums 1Y to 1K onto the intermediate transfer belt 8, and then a composite toner image having the different colors is collectively secondary-transferred onto the recording material S. However, the present disclosure is not limited to this. For example, a direct-transfer image forming apparatus may be used. In this case, a transfer roller is disposed facing a photosensitive drum via a conveyance belt, and a nip portion is formed between the conveyance belt and the photosensitive drum. In addition, a recording material is conveyed by the conveyance belt, and a toner image formed on the photosensitive drum is directly transferred onto the recording material when a transfer voltage is applied to the transfer roller.

Other Embodiments

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-000946, filed on Jan. 8, 2019, which is hereby incorporated by reference herein in its entirety.

What is claimed is:

1. A fixing apparatus for fixing a toner image to a recording material comprising:

an endless fixing belt;

a heating member configured to heat the fixing belt;

a driving rotary member configured to form a nip, for fixing the toner image on the recording material, in cooperation with the fixing belt and configured to rotate the fixing belt;

a plurality of flanges configured to regulate movement of the fixing belt in a longitudinal direction of the fixing belt, each flange being disposed outside of each end of the fixing belt in the longitudinal direction;

a rotatable rubbing member configured to rub the fixing belt;

a contact-and-separation mechanism configured to move the rubbing member between an abutment position at which the rubbing member abuts against the fixing belt and a separation position at which the rubbing member is separated from the fixing belt; and a control unit configured to control the fixing apparatus to perform a rubbing mode in which the contact-and-separation mechanism moves the rubbing member from the separation position to the abutment position in a state where rotation of the fixing belt is stopped and energization of the heating member is stopped, and then rotation of the fixing belt is started and the heating member is energized, so that the rubbing member rubs the fixing belt.

2. The fixing apparatus according to claim 1, further comprising a pressed member that is pressed by the rubbing member via the fixing belt in a state where the rubbing member is positioned at the abutment position.

3. The fixing apparatus according to claim 1, wherein the heating member is a planar heater and the driving rotary member is configured to press the heating member via the fixing belt.

4. The fixing apparatus according to claim 2, further comprising:

a heater holder configured to support the heating member; and a stay configured to support the heater holder, wherein the pressed member is also supported by the stay.

5. The fixing apparatus according to claim 1, further comprising a temperature detecting member configured to detect a temperature of the fixing belt, wherein the control unit is configured to control the contact-and-separation mechanism in the rubbing mode such that in a case that a detected temperature detected by the temperature detecting member reaches a first temperature, the contact-and-separation mechanism moves the rubbing member from the separation position to the abutment position, and in a case that the detected temperature detected by the temperature detecting member does not reach the first temperature, the fixing belt is controlled to rotate, in a state where the heating member is energized and the rubbing member is positioned at the separation position, until the detected temperature reaches the first temperature.

6. The fixing apparatus according to claim 1, wherein the rubbing member rubs the fixing belt for a set time in the rubbing mode.

7. The fixing apparatus according to claim 1, wherein the contact-and-separation mechanism moves the rubbing member from the abutment position to the separation position after the rotation of the fixing belt is stopped in the rubbing mode.

8. The fixing apparatus according to claim 2, wherein the pressed member is separated from the fixing member in a state that the rubbing member is positioned at the separation position.

* * * * *